US006068919A

United States Patent [19]

Ypma et al.

[11] Patent Number: 6,068,919

[45] Date of Patent: May 30, 2000

[54] CELLULOSE FIBRES AND FILAMENTS HAVING A HIGH ELONGATION AT BREAK

[75] Inventors: Marco Ypma, Duiven; Jan Barend Westerink, Lochem; Hendrik Maatman; Hanneke Boerstoel, both of Arnhem; Jannes Veurink, Brummen, all of Netherlands

[73] Assignee: Akzo Nobel N.V., Arnhem, Netherlands

[21] Appl. No.: 09/125,351

[22] PCT Filed: Feb. 13, 1997

[86] PCT No.: PCT/EP97/00693

§ 371 Date: Aug. 25, 1998

§ 102(e) Date: Aug. 25, 1998

[87] PCT Pub. No.: WO97/30198

PCT Pub. Date: Aug. 21, 1997

[30] Foreign Application Priority Data

| | | | |
|---|---|---|---|
| Feb. 14, 1996 | [NL] | Netherlands | 1002337 |
| Jan. 9, 1997 | [NL] | Netherlands | 1004959 |

[51] Int. Cl.[7] ..... D01F 11/02; D21B 1/00

[52] U.S. Cl. ..... 428/393; 428/364; 264/187

[58] Field of Search ..... 428/364, 393; 536/56; 264/187

[56] References Cited

U.S. PATENT DOCUMENTS

| | | | |
|---|---|---|---|
| 4,725,394 | 2/1988 | O'Brien | 106/196 |
| 4,839,113 | 6/1989 | Villaine et al. | 106/169 |
| 5,817,801 | 10/1998 | Boerstoel et al. | 536/56 |
| 5,856,004 | 1/1999 | Maatman et al. | 428/364 |

FOREIGN PATENT DOCUMENTS

| | | |
|---|---|---|
| 0 168 876 | 1/1986 | European Pat. Off. . |
| WO9630222 | 10/1996 | European Pat. Off. . |
| 71 44 34 | 11/1941 | Germany . |
| 60-209006 | 10/1985 | Japan . |
| 7 189019 | 7/1995 | Japan . |
| 54 859 | 7/1943 | Netherlands . |
| 1 348 396 | 10/1987 | U.S.S.R. . |
| 1 397 456 | 5/1988 | U.S.S.R. . |
| 263 810 | 12/1926 | United Kingdom . |
| WO 95/20969 | 8/1995 | WIPO . |
| WO 96/06208 | 2/1996 | WIPO . |

*Primary Examiner*—N. Edwards
*Attorney, Agent, or Firm*—Oliff & Berridge, PLC

[57] ABSTRACT

Cellulose fibres and filaments are prepared from a spinnable, cellulose-containing solution containing 94–100 wt. % cellulose, water, and phosphoric acid and/or anhydrides of phosphoric acid. The resulting cellulose fibres and filaments have an elongation break point greater than 7%. The cellulose-containing solution used to prepare the fibres and filaments may be either isotropic or anisotropic. The cellulose-containing solution is coagulated in a liquid containing water and cations, and the cations are preferably monovalent. Fibres and filaments prepared in this manner are especially suitable for use in textiles.

19 Claims, No Drawings

CELLULOSE FIBRES AND FILAMENTS HAVING A HIGH ELONGATION AT BREAK

BACKGROUND OF THE INVENTION

1. Field of the Invention

The invention pertains to cellulose fibres obtainable by spinning a solution containing 94–100 wt. % of the constituents cellulose, phosphoric acid and/or its anhydrides, and water.

2. Description of Related Art

Such fibres have been described in non-prepublished patent application WO 96/06208 in the name of the applicant, describing cellulose fibres, filaments, and yarn obtained by spinning an anisotropic cellulose solution prepared by dissolving cellulose in a solvent containing 65–80 wt. % of phosphorus pentoxide.

As disclosed in this application, the fibres, filaments, and yarns which are prepared using the cellulose solution described in the application are especially suitable for specific technical uses, for example, as reinforcing material for rubber articles such as vehicle tires and conveyor belts. The fibres, filaments, and yarns described in WO 96/06208 are characterized by a comparatively high breaking tenacity (>500 mN/tex), a comparatively high modulus (>15 N/tex), and a comparatively low elongation at break (<7%). However, such fibres are less suitable for use in textiles due to, among other things, the relative discomfort that comes with wearing such high-modulus fibres, and particular technical applications due to their comparatively low elongation at break.

SUMMARY OF THE INVENTION

The present invention pertains to cellulose fibres which are more suitable for use in textiles and particular technical applications than the cellulose fibres described in WO 96/06208. The invention pertains to cellulose fibres which have an elongation at break of more than 7%.

DETAILED DESCRIPTION OF PREFERRED EMBODIMENTS

The term phosphoric acid in this patent application refers to all inorganic acids of phosphorus and their mixtures. Orthophosphoric acid is the acid of pentavalent phosphorus, that is $H_3PO_4$. Its anhydrous equivalent, that is the anhydride, is phosphorus pentoxide, $P_2O_5$. In addition to orthophosphoric acid and phosphorus pentoxide there is, depending on the quantity of water in the system, a series of acids of pentavalent phosphorus with a water-binding capacity in between those of phosphorus pentoxide and orthophosphoric acid, such as polyphosphoric acid, $H_6P_4O_{13}$, or PPA.

The weight percentage of phosphorus pentoxide in the solvent is calculated by starting from the overall quantity by weight of phosphoric acid including its anhydrides and the total quantity of water in the solvent, converting the acids into phosphorus pentoxide and water, and calculating the percentage of said overall quantity by weight made up by phosphorus pentoxide. In this description water derived from cellulose or from substances which are part of the other constituents and water which is added to obtain the solution are not included in the calculation of the concentration of phosphorus pentoxide in the solvent.

The weight percentage of phosphorus pentoxide in the solution is calculated by starting from the overall quantity by weight of phosphoric acid including its anhydrides and the total quantity of water in the solution, converting the acids into phosphorus pentoxide and water, and calculating which percentage of the overall quantity by weight is made up by phosphorus pentoxide. For that reason in this description water derived from cellulose or from substances which are part of the other constituents and water which is added to obtain the solution are included in the calculation of the concentration of phosphorus pentoxide in the solution.

The weight percentage of cellulose in the solution is calculated by starting from the overall quantity by weight of all constituents in the solution.

Cellulose derivatized with phosphoric acid is included among the constituents making up 94–100 wt. % of the solution to be spun. In the case of cellulose derivatized with phosphoric acid the percentages by weight of cellulose in the solution listed in this patent specification refer to quantities calculated back on the cellulose. This applies in analogous fashion to the quantities of phosphorus mentioned in this specification.

In addition to water, phosphoric acid and/or its anhydrides, and cellulose and/or reaction products of phosphoric acid and cellulose, other substances may be present in the solution. The solution can be prepared by mixing constituents classifiable into four groups: cellulose, water, phosphoric acid including its anhydrides, and other constituents. The "other constituents" may be substances which benefit the processability of the cellulose solution, solvents other than phosphoric acid, or adjuvants or additives, for example to counter cellulose degradation as much as possible, or dyes and the like.

Preferably, the solution is composed of 96–100 wt. % of the constituents cellulose, phosphoric acid and/or its anhydrides, and water. Preferably, no solvents other than phosphoric acid are employed, and adjuvants or additives are present only in amounts of 0 to 4 wt. %, calculated on the overall quantity by weight of the solution. More preferred still is a solution containing the lowest possible quantity of substances other than the constituents cellulose, phosphoric acid and/or its anhydrides, and water, for example, with from 0 to 1 wt. % of additives.

It was found that cellulose fibres can be obtained by spinning isotropic as well as anisotropic cellulose solutions, that is, solutions based on cellulose. Isotropic, spinnable cellulose solutions containing 94–100 wt. % of the constituents cellulose, phosphoric acid and/or its anhydrides, and water have been described in the non-prepublished patent application NL 1002236 in the name of Applicant. Anisotropic cellulose solutions containing 94–100 wt. % of the constituents cellulose, phosphoric acid and/or its anhydrides, and water have been described in non-prepublished patent application WO 96/06208 in the name of Applicant. These isotropic and anisotropic solutions can be obtained extremely simply and within a short period of time making use of cellulose and a solvent containing 65–85 wt. % of phosphorus pentoxide, with the phosphorus pentoxide content in the solvent being calculated in relation to the overall quantity of phosphorus pentoxide and water in the solvent. In obtaining cellulose fibres there was found to be a difference between isotropic and anisotropic solutions.

Isotropic Solutions

Isotropic, spinnable cellulose solutions containing 94–100 wt. % of the constituents cellulose, phosphoric acid and/or its anhydrides, and water can be spun using a so-called dry jet-wet spinning process. In such a spinning process the following steps can be distinguished:

the solution is extruded through one or more capillaries, the extrudate is passed through a layer containing a non-coagulating medium, for example, a layer of air, in which layer the extrudate can be drawn, the extrudate is coagulated in a coagulating liquid to form fibres and/or endless filaments, the fibres/filaments thus formed are washed and gathered/wound.

It was found that when a spinnable, isotropic cellulose solution is employed in such a spinning process, the following have particular significance when it comes to obtaining fibres/filaments having an elongation at break of more than 7%:

The extrudate is not drawn in the layer containing a non-coagulating medium or drawn only to a very limited extent. Preferably, the extrudate is relaxed somewhat in this layer.

The coagulating liquid contains less than 50 wt. % of water, preferably less than 10 wt. % of water. In a preferred preparative process the coagulating liquid will be anhydrous that is the liquid will contain less than 5 wt. % of water, or the coagulating liquid is water with cations added thereto, preferably an aqueous solution which contains monovalent cations as, for example, $Li^+$, $Na^+$ or $K^+$. Such solutions can be obtained, for example, by dissolving lithium, sodium, or potassium phosphate in water.

The fibres/filaments are washed and wound under the lowest possible tension, preference being given to tension-free washing and/or winding of the fibres/filaments.

Suitable for use as coagulants containing less than 50 wt. % water for extrudates obtained from an isotropic, spinnable solution are low-boiling, a-polar organic liquids which have only a limited swelling effect on cellulose or mixtures thereof. Examples of such suitable coagulants include alcohols, ketones, esters or mixtures thereof. The use of acetone as coagulant is preferred. Optionally, water may be added to the coagulant in order to obtain a coagulant containing less than 50 wt. % of water. However, it is preferred to employ a coagulant containing less than 10 wt. % of water, more particularly, a coagulant which is essentially anhydrous. Suitable for use as coagulants containing water and cations added thereto for extrudates obtained from an isotropic, spinnable solution are aqueous solutions containing monovalent cations as, for example, $Li^+$, $Na^+$ or $K^+$. Such solutions can be obtained, for example, by dissolving lithium, sodium, or potassium phosphate in water.

Anisotropic Solutions

Anisotropic cellulose solutions containing 94–100 wt. % of the constituents cellulose, phosphoric acid and/or its anhydrides, and water can also be spun using a dry jet-wet spinning process. It was found that when an anisotropic cellulose solution is employed in such a spinning process, the following have particular significance when it comes to obtaining fibres/filaments having an elongation at break of more than 7%:

The coagulating liquid contains mostly water optionally with cations added thereto, preferably contains monovalent cations added thereto, or the coagulating liquid contains less than 50 wt. % of water, preferably less than 10 wt. % of water.

The fibres/filaments are washed and wound under the lowest possible tension.

If the coagulating liquid contains less than 50 wt. % of water, the fibres/filaments are coagulated under low tension.

Suitable for use as coagulants containing water and cations added thereto for extrudates obtained from an anisotropic, spinnable solution are aqueous solutions containing monovalent cations as, for example, $Li^+$, $Na^+$ or $K^+$. Such solutions can be obtained, for example, by dissolving lithium, sodium, or potassium phosphate in water. Suitable for use as coagulants containing less than 50 wt. % water for extrudates obtained from an anisotropic, spinnable solution are low-boiling, a-polar organic liquids which have only a limited swelling effect on cellulose or mixtures thereof. Examples of such suitable coagulants include alcohols, ketones, esters or mixtures thereof. The use of acetone as coagulant is preferred. Optionally, water may be added to the coagulant in order to obtain a coagulant containing less than 50 wt. % of water. However, it is preferred to employ a coagulant containing less than 10 wt. % of water, more particularly, a coagulant which is essentially anhydrous. It was found that in the spinning of anisotropic solution the use of a coagulant containing less than 50 wt. % of water, more particularly, a coagulant which is essentially anhydrous, enables the preparation of cellulose fibres and filaments with an elongation at break above 7% and a breaking tenacity above 600 mN/tex, more in particular a breaking tenacity above 700 mN/tex.

A single spinneret plate having the desired number of capillaries may be used not only for extruding cellulose fibres and filaments having an elongation at break of more than 7% from isotropic as well as anisotropic solutions, but also for extruding the cellulose multifilament yarns much in demand in actual practice which have an elongation at break of more than 7% and contain from 30 to 10 000, preferably from 100 to 2000, filaments. The manufacture of such multifilament yarns preferably is carried out on a cluster spinning assembly containing a number of spinning orifice clusters, as described in EP 168 876 or on a spinning assembly with one or more spinnerets, which spinnerets are described in WO 95/20969.

Following coagulation the formed fibres/filaments may be washed. While the washing liquids may be selected from the same group of low-boiling organic solvents or mixtures of these solvents used as coagulants, the preferred washing liquid is water.

After the solution has been coagulated and washed, the resulting product may be neutralized, for example, by washing it with a solution of $Na_2CO_3.10H_2O$ in water.

The resulting fibres, filaments, and yarns have particularly favourable properties, especially for textile applications and particular technical applications. In addition to an elongation at break of more than 7% these products have a breaking toughness of more than 10 J/g, more particularly a breaking toughness of more than 15 J/g. It was found that because of the composition of the spinning solution the fibres contain at least 0.02 wt. % of cellulose-bound phosphorus. Also, the fibres generally have a low modulus and because of the presence of cellulose-bound phosphorus exhibit good flame retardance, good dye uptake, and good moisture absorption. The fibres, filaments, and yarns exhibit substantially better flame retardance than cotton or well-known synthetic cellulose fibres such as viscose yarn. The flame retardance of the fibres, filaments or yarns can be measured, for example, by means of an LOI test.

Determination of Isotropy/Anisotropy

Visual determination of the isotropy or anisotropy of the solution was performed with the aid of a polarization microscope (Leitz Orthoplan-Pol (100x)). To this end about 100 mg of the solution to be defined were arranged between two slides and placed on a Mettler FP 82 hot-stage plate, after which the heating was switched on and the specimen heated at a rate of about 5° C./min. In the transition from anisotropic to isotropic, that is, from coloured, or birefringent, to black, the temperature is read off at virtual black. The transition temperature is indicated as $T_{ni}$. The visual assessment during the phase transition was compared with an intensity measurement using a photosensitive cell mounted on the microscope. For this intensity measurement a specimen of 10–30 $\mu$m was arranged on a slide such that no colours were visible when crossed polarizers were employed. Heating was carried out as described above. The photosensitive cell, connected to a recorder, was used to write the intensity as a function of time. Above a certain temperature which differs for the different solutions, there was a linear decrease of the intensity. Extrapolation of this line to an intensity of 0 gave the $T_{ni}$. In all cases, the value found proved a good match for the value found by the above-mentioned method. Isotropic solutions do not display birefringence at room temperature. This means that $T_{ni}$ will be below 25° C. However, it may be the case that such solutions do not display an isotropy/anisotropy transition.

Determination of DP

The degree of polymerization (DP) of the cellulose was determined with the aid of an Ubbelohde type 1 (k=0.01). To this end the cellulose specimens to be measured were dried in vacuo for 16 hours at 50° C. after neutralization, or the amount of water in the copper II ethylene diamine/water mixture was corrected to take into account the water in the cellulose. In this way an 0.3 wt. % of cellulose-containing solution was made using a copper II ethylene diamine/water mixture (1/1). On the resulting solution the viscosity ratio (visc. rat. or $\eta_{rel}$) was determined, and from this the limiting viscosity ($\eta$) was determined in accordance with the formula:

$$[\eta] = \frac{visc.rat - 1}{c + (k \times c \times (visc.rat. - 1))} \times 100$$

wherein c=cellulose concentration of the solution (g/dl) and k=constant=0.25

From this formula the degree of polarization DP was determined as follows:

$$DP = \frac{[\eta]}{0.42} \text{ (for } [\eta] < 450 \text{ ml/g), or}$$

$$DP^{0.76} = \frac{[\eta]}{2.29} \text{ (for } [\eta] > 450 \text{ ml/g)}$$

Determining the DP of the cellulose in the solution proceeded as described above after the following treatment:

20 g of the solution were charged to a Waring Blender (1 liter), 400 ml of water were added, and the whole was then mixed at the highest setting for 10 minutes. The resulting mixture was transferred to a sieve and washed thoroughly with water. Finally, there was neutralization with a 2%-$NaHCO_3$ solution for several minutes and after-washing with water to a pH of about 7. The DP of the resulting product was determined as described above, starting from the preparation of the copper II ethylene diamine/water/cellulose solution.

Determination of Phosphorus Content

The quantity of phosphorus bound to the cellulose in the solution, or in a cellulose product made using the solution, can be determined by 300 mg of cellulose solution, which solution has been coagulated and, after thorough washing for 16 hours at 50° C., dried in vacuo and then stored in a sealed sampling vessel, being combined in a decomposition flask with 5 ml of concentrated sulphuric acid and 0.5 ml of an Yttrium solution containing 1000 mg/l of Yttrium. The cellulose is carbonized with heating. After carbonization hydrogen peroxide is added to the mixture in portions of 2 ml, until a clear solution is obtained. After cooling the solution is made up with water to a volume of 50 ml. Inductive Coupled Plasma-Emission Spectrometry, ICP-ES, is used to measure, by means of a phosphorus calibration line determined using reference samples containing 100, 40, 20, and 0 mg/l of phosphorus, respectively, the phosphorus content in the solution to be measured with the aid of the following equation:

$$\text{phosphorus content } (\%) = (P_{conc}(\text{mg/l}) \times 50)/(C_w(\text{mg}) \times 10)$$

wherein:

$P_{conc}$=the phosphorus concentration in the solution to be measured and $C_w$=the weighed out quantity of coagulated and washed cellulose.

Yttrium is added as internal standard to correct the solutions' viscosity variations. The phosphorus content is measured at a wavelength of 213.6 nm, the internal standard is measured at a wavelength of 224.6 nm.

Mechanical Properties

The mechanical properties of the filaments and the yarns were determined in accordance with ASTM standard D2256-90, using the following settings. The filament properties were measured on filaments clamped with ARNITEL gripping surfaces of 10×10 mm. The filaments were conditioned for 16 hours at 20° C. and 65% relative humidity. The length between grips was 100 mm, the filaments were elongated at a constant elongation of 10 mm/min. The yarn properties were determined on yarns clamped with Instron 4C clamps. The yarns were conditioned for 16 hours at 20° C. and 65% relative humidity. The length between grips was 500 mm, the yarns were elongated at a constant elongation of 50 mm/min. The yarns were twisted, the number of twists per meter being 4000/√linear density [dtex]. The linear density of the filaments, expressed in dtex, was calculated on the basis of the functional resonant frequency according to ASTM D 1577-66, Part 25, 1968; the yarn's linear density was determined by weighing. The tenacity, elongation, and initial modulus were derived from the load-elongation curve and the measured filament or yarn linear density. The initial modulus, In. Mod., was defined as the maximum modulus at an elongation of less than 2%. The final modulus was defined as the maximum modulus at an elongation of more than 2%.

EXAMPLES

The invention will be illustrated with reference to examples.

Unless otherwise specified, the following starting materials were employed to prepare the solutions in the examples.

TABLE 1

| | DR | LD [dtex] | BT [mN/tex] | EaB [%] | IM [N/tex] | FM [N/tex] | Bto [J/g] |
|---|---|---|---|---|---|---|---|
| 1a | 0.6 | 3320 | 180 | 17.4 | 3.5 | 1.6 | 18.6 |
| 1b | 0.9 | 2390 | 270 | 11.5 | 5.7 | 3.0 | 17.0 |
| 1c | 1.1 | 1770 | 310 | 9.5 | 7.6 | 4.2 | 16.1 |
| 1d | 1.5 | 1370 | 380 | 8.4 | 9.2 | 6.0 | 16.6 |

Example 1

An isotropic cellulose solution obtained by the process described in the non-prepublished patent application NL 1002236 in the name of Applicant, containing 7.6 wt. % of cellulose (Alphacell C-100, DP=2300), was extruded at 40° C. through a spinneret having 375 capillaries each with a diameter of 65 $\mu$m. The extruded solution was passed through an air gap and coagulated in a bath filled with acetone of about 35° C. After coagulation the multifilament yarn formed was washed with water, neutralized with a 2.5 wt. % $Na_2CO_3.10H_2O$ solution in water, and washed again with water. The yarn was then dried under very low tension. Several experiments were carried out with different draw ratios in the air gap, the draw ratio being defined as the throughput rate in the coagulation bath divided by the rate at which the solution was extruded from the capillaries. The mechanical properties of the resulting yarns were measured. The data is listed in Table 1.

TABLE 2

| | pH | LD [dtex] | BT [mN/tex] | EaB [%] | IM [N/tex] | FM [N/tex] | Bto [J/g] |
|---|---|---|---|---|---|---|---|
| 2a | 11.5 | 495 | 300 | 7.5 | 14.8 | 3.5 | 15.1 |
| 2b | 9.4 | 490 | 300 | 7.5 | 15.0 | 3.5 | 15.1 |
| 2c | 7.3 | 485 | 300 | 7.6 | 15.0 | 3.6 | 15.3 |
| 2d | 6.7 | 485 | 295 | 7.4 | 14.7 | 3.6 | 14.8 |
| 2e | 5.9 | 510 | 265 | 8.6 | 8.5 | 3.0 | 13.6 |
| 2f | 5.5 | 515 | 260 | 7.3 | 13.0 | 3.1 | 12.9 |
| 2g | 2.8 | 515 | 250 | 8.3 | 8.3 | 2.9 | 12.6 |

wherein DR=draw ratio, LD=Linear density, BT=Breaking tenacity, EaB=Elongation at break, IM=Initial modulus, FM=Final modulus, and Bto=Breaking toughness.

Example 2

An anisotropic cellulose solution obtained by the process described in non-prepublished patent application WO 96/06208 in the name of Applicant, containing 18 wt. % of cellulose (Buckeye V60, DP=820), was extruded at 55° C. through a spinneret having 250 capillaries each with a diameter of 65 $\mu$m. The extruded solution was passed through an air gap and coagulated in a coagulation bath in a solution of 2 wt. % of $Na_3PO_4$ in water of 12° C. The extrudate was drawn 5.7× in the air gap. The resulting yarn was washed with water, finished, and dried at 150° C. During washing and drying the tension exerted on the yarn was kept as low as possible. The yarns from Examples 2e and 2g were dried tension-free. During the experiment the degree of acidity of the coagulating liquid increased. The mechanical properties of the resulting yarns were measured. The data is listed in Table 2.

TABLE 3

| | Coagulation bath water + | $T_{coag}$ [° C.] | neutr. | BT [mN/tex] | EaB [%] | IM [N/tex] | Bto [J/g] |
|---|---|---|---|---|---|---|---|
| 3a | — | 18 | − | 276 | 9.2 | 13.0 | 16.9 |
| 3b | — | 18 | + | 280 | 9.6 | 13.0 | 17.8 |
| 3c | 5 gew. % $ZnSO_4$ | 23 | − | 260 | 10.1 | 12.0 | |
| 3d | 5 gew. % $ZnSO_4$ | 23 | + | 260 | 10.6 | 11.5 | |

wherein pH=degree of acidity of the coagulating liquid, LD=Linear density, BT=Breaking tenacity, EaB=Elongation at break, IM=Initial modulus, FM=Final modulus, and Bto=Breaking toughness.

Example 3

An anisotropic cellulose solution containing 18 wt. % of cellulose (Buckeye V60, DP=820), obtained by the process described in non-prepublished patent application WO 96/06208 in the name of Applicant, for example, by mixing cellulose with a solvent containing 73.9 wt. % $P_2O_5$, was extruded at 46° C. through a spinneret having 375 capillaries each with a diameter of 65 $\mu$m. The extruded solution was passed through an air gap and coagulated in a coagulation bath. The resulting yarn was washed with water, finished, and dried at 150° C. During washing and drying the tension exerted on the yarn was kept as low as possible. During the experiment the composition of the coagulant in the coagulation bath was changed. Some yarns were neutralised with a 2.5 wt. % $Na_2CO_3.10H_2O$ solution in water. The mechanical properties of the resulting yarns were measured. The data is listed in Table 3.

TABLE 4A

| | spinning conditions | | | |
|---|---|---|---|---|
| Example | $T_{coag}$ [° C.] | neutralisation solution | finish step | drying step |
| 4a | 13.5 | 2.5 wt. % $Na_2CO_3$ | yes, RT32A | tensionless, 25° C. |
| 4b | 12.5 | 0.5 wt. % $Na_2CO_3$ | no | 160° C. on heated godet |
| 4c | −22.1 | 2.5 wt. % $Na_2CO_3$ | yes, RT32A | 160° C. on heated godet |

wherein $I_{coag}$=temperature of the coagulating liquid, BT=Breaking tenacity, EaB=Elongation at break, IM=Initial modulus, and Bto=Breaking toughness.

Example 4

An anisotropic cellulose solution containing 18 wt. % of cellulose (Buckeye V60, DP=820), obtained by the process described in non-prepublished patent application WO 96/06208 in the name of Applicant, for example, by mixing cellulose with a solvent containing 74.1 wt. % $P_2O_5$, was extruded through a spinning assembly with four spinnerets, each spinneret having 375 capillaries each with a diameter of 65 $\mu$m. The extruded solution was passed through an air gap and coagulated in acetone. The resulting yarns were washed with water, neutralised by treatment with an $Na_2CO_3$ solution, washed again with water some yarns were finished, all yarns were dried, and wound onto a bobbin with a speed of 100 m/min The spinning conditions are given in Table 4A.

TABLE 4B

| Example | LD [dtex] | BT [mN/tex] | EaB [%] | IM [N/tex] | Bto [J/g] |
|---|---|---|---|---|---|
| | mechanical properties | | | | |
| 4a | 2510 | 750 | 7.5 | 15.1 | 27.0 |
| 4b | 2570 | 882 | 7.4 | 18.5 | 31.6 |
| 4c | 2653 | 846 | 7.1 | 21.4 | 30.5 |

The mechanical properties of the resulting yarns were measured. The data is listed in Table 4B.

TABLE 4B

| Example | LD [dtex] | BT [mN/tex] | EaB [%] | IM [N/tex] | Bto [J/g] |
|---|---|---|---|---|---|
| | mechanical properties | | | | |
| 4a | 2510 | 750 | 7.5 | 15.1 | 27.0 |
| 4b | 2570 | 882 | 7.4 | 18.5 | 31.6 |
| 4c | 2653 | 846 | 7.1 | 21.4 | 30.5 |

wherein LD=Linear density, BT=Breaking tenacity, EaB=Elongation at break, IM=Initial modulus, and Bto=Breaking toughness.

What is claimed is:

1. A cellulose fibre, said fibre generated by spinning a solution, the solution comprising:

94–100 wt. % of cellulose, water and at least one of phosphoric acid and anhydrides of phosphoric acid; and wherein the fibre has an elongation at break greater than 7%.

2. The cellulose fibre of claim 1, wherein the fibre is an endless filament.

3. The cellulose fibre of claim 1, wherein the breaking toughness of the fibre is greater than 10 J/g.

4. A cellulose yarn comprising cellulose fibres of claim 1.

5. The cellulose yarn of claim 4, wherein the yarn contains more than 50 filaments.

6. The cellulose yarn of claim 4, wherein the breaking toughness of the yarn is greater than 10 J/g.

7. The cellulose yarn of claim 4, wherein the breaking toughness of the yarn is greater than 15 J/g.

8. A process for producing cellulose fibres or filaments from a spinnable cellulose-containing solution, the solution comprising:

94–100 wt. % of cellulose, water and at least one of phosphoric acid and anhydrides of phosphoric acid;

spinning the solution; and coagulating the spun solution in a liquid, the liquid comprising water with cations added thereto, wherein the fibres or filaments have an elongation at break greater than 7%.

9. The process of claim 8, wherein the cellulose-containing solution is isotropic.

10. The process of claim 8, wherein spinning of the solution is performed using a dry jet-wet spinning process.

11. The process of claim 8, wherein the cations are monovalent.

12. The process of claim 8, further comprising washing and drying the filaments or fibres under low tension following coagulation.

13. The process of claim 12, wherein the fibres or filaments are washed in water.

14. A process for producing cellulose fibres or filaments from an anisotropic cellulose-containing solution, comprising:

spinning the solution; and coagulating the spun solution in a liquid, the liquid comprising water with cations added thereto, wherein the fibres or filaments have an elongation at break greater than 7%.

15. The process of claim 14, wherein spinning of the solution is performed using a dry jet-wet spinning process.

16. The process of claim 14, wherein the cations are monovalent.

17. The process of claim 14, further comprising washing and drying the filaments or fibres under low tension following coagulation.

18. The process of claim 17, wherein the fibres or filaments are washed in water.

19. The cellulose fibre of claim 1, wherein the breaking toughness of the fibre is greater than 15 J/g.

* * * * *

UNITED STATES PATENT AND TRADEMARK OFFICE

CERTIFICATE OF CORRECTION

PATENT NO. : 6,068,919
DATED : May 30, 2000
INVENTOR(S) : Marco Ypma; Jan Barend Westerink; Hendrik Maatman; Hanneke Boerstoel; and Jannes Veurink It is certified that error appears in the above-identified patent and that said Letters Patent is hereby corrected as shown below:

Column 5,
Line 3, change "coloured" to -- colored --;
Line 29, change " an" to -- a --; and
Line 43, change "polarization" to -- polymerization --.

Column 7,
Lines 1-9, change "

Table 1

| | DR | LD [dtex] | BT [mN/tex] | EaB [%] | IM [N/tex] | FM [N/tex] | Bto [J/g] |
|---|---|---|---|---|---|---|---|
| 1a | 0.6 | 3320 | 180 | 17.4 | 3.5 | 1.6 | 18.6 |
| 1b | 0.9 | 2390 | 270 | 11.5 | 5.7 | 3.0 | 17.0 |
| 1c | 1.1 | 1770 | 310 | 9.5 | 7.6 | 4.2 | 16.1 |
| 1d | 1.5 | 1370 | 380 | 8.4 | 9.2 | 6.0 | 16.6"; |

to --

| Material | Manufacturer and product code | Content $P_2O_5$ [%] |
|---|---|---|
| $P_2O_5$ | J.T. Baker, 0193 | 98 |
| $H_3PO_4$ | La Fonte Electrique SA, Bex Suisse crystallised, >99% (98.3% analysed) | 71.2 |
| $H_4P_2O_7$ | Fluka Chemika, 83210, 97% (98.8% anal.) | 78.8 |
| PPA* | Caldic | 84.5 |

*PPA = polyphosphoric acid--.

UNITED STATES PATENT AND TRADEMARK OFFICE

CERTIFICATE OF CORRECTION

PATENT NO. : 6,068,919
DATED : May 30, 2000
INVENTOR(S) : Marco Ypma; Jan Barend Westerink; Hendrik Maatman; Hanneke Boerstoel; and Jannes Veurink It is certified that error appears in the above-identified patent and that said Letters Patent is hereby corrected as shown below:

Column 7,
Lines 34-43, change "

Table 2

| | pH | LD [dtex] | BT [mN/tex] | EaB [%] | IM [N/tex] | FM [N/tex] | Bto [J/g] |
|---|---|---|---|---|---|---|---|
| 2a | 11.5 | 495 | 300 | 7.5 | 14.8 | 3.5 | 15.1 |
| 2b | 9.4 | 490 | 300 | 7.5 | 15.0 | 3.5 | 15.1 |
| 2c | 7.3 | 485 | 300 | 7.6 | 15.0 | 3.6 | 15.3 |
| 2d | 6.7 | 485 | 295 | 7.4 | 14.7 | 3.6 | 14.8 |
| 2e | 5.9 | 510 | 265 | 8.6 | 8.5 | 3.0 | 13.6 |
| 2f | 5.5 | 515 | 260 | 7.3 | 13.0 | 3.1 | 12.9 |
| 2g | 2.8 | 515 | 250 | 8.3 | 8.3 | 2.9 | 12.6"; |

to –

Table 1

| | DR | LD [dtex] | BT [mN/tex] | EaB [%] | IM [N/tex] | FM [N/tex] | Bto [J/g] |
|---|---|---|---|---|---|---|---|
| 1a | 0.6 | 3320 | 180 | 17.4 | 3.5 | 1.6 | 18.6 |
| 1b | 0.9 | 2390 | 270 | 11.5 | 5.7 | 3.0 | 17.0 |
| 1c | 1.1 | 1770 | 310 | 9.5 | 7.6 | 4.2 | 16.1 |
| 1d | 1.5 | 1370 | 380 | 8.4 | 9.2 | 6.0 | 16.6–. |

UNITED STATES PATENT AND TRADEMARK OFFICE

CERTIFICATE OF CORRECTION

PATENT NO. : 6,068,919
DATED : May 30, 2000
INVENTOR(S) : Marco Ypma; Jan Barend Westerink; Hendrik Maatman; Hanneke Boerstoel; and Jannes Veurink It is certified that error appears in the above-identified patent and that said Letters Patent is hereby corrected as shown below:

Column 8,
Lines 1-9, change "

Table 3

| | Coagulation bath water + | $T_{coag}$ [°C] | neutr. | BT [mN/tex] | EaB [%] | IM [N/tex] | Bto [J/g] |
|---|---|---|---|---|---|---|---|
| 3a | - | 18 | - | 276 | 9.2 | 13.0 | 16.9 |
| 3b | - | 18 | + | 280 | 9.6 | 13.0 | 17.8 |
| 3c | 5 gew.% $ZnSO_4$ | 23 | - | 260 | 10.1 | 12.0 | |
| 3d | 5 gew.% $ZnSO_4$ | 23 | + | 260 | 10.6 | 11.5 | |

";

to –

Table 2

| | pH | LD [dtex] | BT [mN/tex] | EaB [%] | IM [N/tex] | FM [N/tex] | Bto [J/g] |
|---|---|---|---|---|---|---|---|
| 2a | 11.5 | 495 | 300 | 7.5 | 14.8 | 3.5 | 15.1 |
| 2b | 9.4 | 490 | 300 | 7.5 | 15.0 | 3.5 | 15.1 |
| 2c | 7.3 | 485 | 300 | 7.6 | 15.0 | 3.6 | 15.3 |
| 2d | 6.7 | 485 | 295 | 7.4 | 14.7 | 3.6 | 14.8 |
| 2e | 5.9 | 510 | 265 | 8.6 | 8.5 | 3.0 | 13.6 |
| 2f | 5.5 | 515 | 260 | 7.3 | 13.0 | 3.1 | 12.9 |
| 2g | 2.8 | 515 | 250 | 8.3 | 8.3 | 2.9 | 12.6–. |

UNITED STATES PATENT AND TRADEMARK OFFICE

CERTIFICATE OF CORRECTION

PATENT NO. : 6,068,919
DATED : May 30, 2000
INVENTOR(S) : Marco Ypma; Jan Barend Westerink; Hendrik Maatman; Hanneke Boerstoel; and Jannes Veurink It is certified that error appears in the above-identified patent and that said Letters Patent is hereby corrected as shown below:

Column 8,
Lines 36-46, change "

Table 4A, spinning conditions

| Example | $T_{coag}$ [°C] | neutralisation solution | finish step | drying step |
|---|---|---|---|---|
| 4a | 13.5 | 2.5 wt.% $Na_2CO_3$ | yes, RT32A | tensionless, 25°C |
| 4b | 12.5 | 0.5 wt.% $Na_2CO_3$ | no | 160°C on heated godet |
| 4c | -22.1 | 2.5 wt.% $Na_2CO_3$ | yes, RT32A | 160°C on heated godet"; |

to –

Table 3

| | Coagulation bath water + | $T_{coag}$ [°C] | neutr. | BT [mN/tex] | EaB [%] | IM [N/tex] | Bto [J/g] |
|---|---|---|---|---|---|---|---|
| 3a | - | 18 | - | 276 | 9.2 | 13.0 | 16.9 |
| 3b | - | 18 | + | 280 | 9.6 | 13.0 | 17.8 |
| 3c | 5 gew.% $ZnSO_4$ | 23 | - | 260 | 10.1 | 12.0 | |
| 3d | 5 gew.% $ZnSO_4$ | 23 | + | 260 | 10.6 | 11.5 | |

–.

UNITED STATES PATENT AND TRADEMARK OFFICE

CERTIFICATE OF CORRECTION

PATENT NO. : 6,068,919 
DATED : May 30, 2000
INVENTOR(S) : Marco Ypma; Jan Barend Westerink; Hendrik Maatman; Hanneke Boerstoel; and Jannes Veurink It is certified that error appears in the above-identified patent and that said Letters Patent is hereby corrected as shown below:

Column 9,
Lines 2-10, change "

Table 4B, mechanical properties

| Example | LD [dtex] | BT [mN/tex] | EaB [%] | IM [N/tex] | Bto [J/g] |
|---|---|---|---|---|---|
| 4a | 2510 | 750 | 7.5 | 15.1 | 27.0 |
| 4b | 2570 | 882 | 7.4 | 18.5 | 31.6 |
| 4c | 2653 | 846 | 7.1 | 21.4 | 30.5"; |

to –

Table 4A, spinning conditions

| Example | $T_{coag}$ [°C] | neutralisation solution | finish step | drying step |
|---|---|---|---|---|
| 4a | 13.5 | 2.5 wt.% $Na_2CO_3$ | yes, RT32A | tensionless, 25°C |
| 4b | 12.5 | 0.5 wt.% $Na_2CO_3$ | no | 160°C on heated godet |
| 4c | -22.1 | 2.5 wt.% $Na_2CO_3$ | yes, RT32A | 160°C on heated godet--. |

Signed and Sealed this

Eleventh Day of December, 2001

*Attest:*

Nicholas P. Godici

*Attesting Officer*

NICHOLAS P. GODICI
*Acting Director of the United States Patent and Trademark Office*